United States Patent [19]

Whang et al.

[11] Patent Number: 4,543,059

[45] Date of Patent: Sep. 24, 1985

[54] SLOTTED CANTILEVER DIFFUSION TUBE SYSTEM AND METHOD AND APPARATUS FOR LOADING

[75] Inventors: J. S. Whang, Scottsdale; Andrew F. Wollmann, Chandler, both of Ariz.

[73] Assignee: Quartz Engineering & Materials, Inc., Tempe, Ariz.

[21] Appl. No.: 631,929

[22] Filed: Jul. 18, 1984

[51] Int. Cl.[4] ..... F27D 3/00; F27B 9/14; F27B 5/02; F27D 5/00

[52] U.S. Cl. ..... 432/11; 432/123; 432/208; 432/239; 432/258

[58] Field of Search ..... 432/11, 123, 208, 239, 432/258; 220/213

[56] References Cited

U.S. PATENT DOCUMENTS 4,459,104 7/1984 Wollmann ..... 432/123

4,468,195 8/1984 Sasaki et al. ..... 432/239

*Primary Examiner*—John J. Camby

*Attorney, Agent, or Firm*—Cahill, Sutton & Thomas

[57] ABSTRACT

A cantilever tube for carrying loaded wafer boats into a diffusion furnace and confining flow of gas through the wafers includes an elongated slot extending from an open end of the tube to a predetermined region in which the wafer boats are positioned, the wafer boats abutting each other and forming a sealing cover for the elongated slot. A narrow boat carrier supported on a carriage system extends through the elongated slot and carries a wafer boat loaded with wafers into the open end and to the predetermined region in the cantilever tube without allowing either the carrier, or the wafer boat, or the wafers to touch the cantilever tube. The carrier lowers the boat onto the bottom inner surface of the tube, causing the boat to cover a portion of the elongated slot. The procedure is repeated for subsequent wafer boats, each of which abuts the previous one, to effectively close and seal the elongated slot when all of the wafer boats are positioned inside the cantilever tube.

27 Claims, 32 Drawing Figures

SLOTTED CANTILEVER DIFFUSION TUBE SYSTEM AND METHOD AND APPARATUS FOR LOADING

REFERENCE TO RELATED APPLICATIONS

This application is related to copending application Ser. No. 499,915, filed June 1, 1983, now U.S. Pat. No. 4,459,104, and entitled "Cantilever Diffusion Tube Apparatus and Method" by Andrew F. Wollman, assigned to the present Assignee, and fully incorporated herein by reference.

BACKGROUND OF THE INVENTION

The invention relates to apparatus and methods for loading of quartz boats of semiconductor wafers into diffusion furnaces for processing at elevated temperatures, without generating excessive numbers of defect-causing particulates, and relates more particularly to cantilever diffusion tubes for carrying the wafer-loaded diffusion boats into diffusion furnaces without causing quartz-to-quartz abrasion, and relates still more particularly to methods and apparatus for effectuating loading and unloading of wafer boats into cantilever diffusion tubes, and yet more particularly to methods and apparatus for effecting the foregoing operations without sagging of the cantilever diffusion tube, even at extremely high temperatures in the furnace.

A cantilever tube system described in the above-mentioned Wollman application solves many of the problems associated with prior systems for loading diffusion furnace tubes, and particularly prior cantilever diffusion systems with rods that support loaded wafer boats in cantilever fashion within a diffusion furnace tube as an expedient for reducing generation of defect-causing particulates caused by quartz-to-quartz frition. The particular problems solved by the cantilever tube system described in the Wollman application are described in detail therein and, include avoiding excessive thermal shock to wafers being withdrawn from the hot zone of the diffusion furnace while nevertheless allowing relatively rapid withdrawal rates and use of far less nitrogen purging gas to isolate the wafers from premature exposure to atmospheric oxygen and thereby avoiding excess $Q_{SS}$ shifts. That cantilever tube system further isolates the semiconductor wafers, after they are withdrawn from the hot zone of the diffusion furnace and while they are cooling in the loading station, from particulates in the non-laminar air flow that usually exists in diffusion furnace loading stations. The cantilever tube system also greatly reduces the amount of cost and labor associated with the required frequent cleaning of diffusion furnace tubes, by confining nearly all contamination associated with reactor tube processes to the inside of the cantilever tube which can be quickly and easily removed and replaced by a clean one without excessive down time or inoperative time. Non-uniform gas flow caused by the presence of large cantilever rods of prior cantilever systems in the gas flow path is avoided by the system described in the Wollman application, and the high thermal mass and non-uniform temperature variations and resulting processing variations caused by prior cantilever loading systems are also avoided by the system described in the Wollman application.

The cantilever tube described in the Wollman application is loaded with wafer boats by passing the loaded wafer boats through a large side window in the wall of the diffusion tube. A close fitting quartz cover is positioned over the window after all boats have been loaded, before insertion of the cantilever tube into the hot zone of a diffusion furnace. While the technique of loading and unloading wafer boats through the side window in the diffusion tube is effective, it has become apparent that in some instances this technique is inconvenient and is not well suited to easily designed, low cost automated wafer loading systems.

Thus, there remains a need for a more convenient cantilever diffusion tube apparatus and technique for rapidly and inexpensively loading a plurality of diffusion boats loaded with semiconductor wafers into a cantilever tube.

Several embodiments of the invention described in the Wollman application provide wheels built into a cantilever diffusion tube for supporting the end and center portions of a cantilever diffusion tube to avoid sagging that would otherwise result from prolonged exposure of the cantilever diffusion tube to very high temperatures in the diffusion furnace tube. For example, for quartz cantilever tubes, temperatures in excess of approximately 1200° Centigrade cause sagging of the cantilever tubes. Although the described technique is workable, there exists a need for a simpler approach to avoiding sagging of a cantilever tube exposed to exceedingly high temperatures in a diffusion furnace.

Some present cantilever systems, including the ones described in the above identified Wollman application, feed gas from the loading station side of the diffusion furnace, whereas conventional diffusion furnaces feed processing gases from the opposite end of the diffusion furnace. It would be helpful if there were a convenient, practical means of feeding gas into the cantilever tube of the above Wollman application with a gas feed connection to the pigtail of the diffusion tube.

SUMMARY OF THE INVENTION

Accordingly, it is an object of the invention to provide an improved cantilever diffusion tube and apparatus and method for loading and unloading wafer boats therein.

It is another object of the invention to provide a system that is especially suitable for automated loading of wafers into a cantilever diffusion tube.

It is another object of the invention to provide an apparatus and method especially suitable for automated loading and unloading of wafer boats into a cantilever diffusion tube, automatic insertion and withdrawal of the loaded cantilever tube into a diffusion furnace, and unloading of the boat loads of processed wafers from the cantilever tube.

It is another object of the invention to provide an improved cantilever diffusion tube apparatus and method suitable for processing of boat loads of semiconductor wafers at extremely high furnace temperatures exceeding temperature levels at which sagging of the cantilever tubes can be avoided.

It is another object of the invention to provide an apparatus and method for effectively accomplishing soft landing of a cantilever diffusion tube in a diffusion furnace.

It is another object of the invention to provide a cantilever system for loading and unloading boatloads of wafers into and out of a diffusion furnace and avoiding quartz-to-quartz friction and the like, and maintaining a copntrolled atmosphere for the wafers driving the loading and unloading.

It is another object of the invention to provide a cantilever tube diffusion system that allows use of conventional gas feed to the pigtail of a diffusion furnace tube and provide the benefits of double wall isolation of the wafers during processing in a diffusion furnace.

Briefly described, and in accordance with one embodiment thereof, the invention provides a cantilever tube for carrying boat loads of semiconductor wafers into and out of the hot zone of a furnace of the type commonly referred to as a diffusion furnace, the cantilever tube having an elongated slot extending from a distal open end thereof along the bottom surface of the cantilever tube to a boundary of the portion of the cantilever tube wherein wafer boats are to be supported during loading and unloading and/or processing in the furnace. The wafer boats have semicylindrical bottom surfaces that rest on the edges of the elongated slot, and effectively seal the interior of the cantilever tube with respect to the elongated slot when the cantilever tube is loaded with wafer boats. In one described embodiment of this invention, the cantilever tube is supported at its proximal end by means of a "door" plate and a clamping mechanism that clamps the door plate to seal the open proximal end of the cantilever tube, except for gas tubes that allow flow of reactant gas or purging gas through the cantilever tube and through the boat loads of wafers supported therein during insertion of the cantilever tube into a diffusion furnace and also during withdrawal of the cantilever tube from the diffusion furnace. The door plate clamping mechanism is supported on a laterally movable carriage mechanism that moves along a track to effectuate insertion and withdrawal of the cantilever tube. Boat loads of wafers are loaded into the cantilever tube by means of a boat carrier mechanism having a narrow wafer boat supporting platform that extends from a supporting member up through the elongated slot so that the upper surface of the boat carrying platform supports a wafer boat above the bottom inner surface of the cantilever tube and carries that wafer boat laterally to a predetermined region inside the cantilever tube. The boat carrying platform then is lowered, causing the semicylindrical bottom surface of the wafer boat to cover and seal a portion of elongated slot. The boat carrier mechanism is lowered further to break contact with the wafer boat, and is withdrawn from the cantilever tube. The procedure is repeated for additional wafer boats, each of which is positioned so that one end of it abuts a previously loaded wafer boat in a somewhat sealing relationship thereto, and covers and effectively seals a further portion of the elongated slot. After all of the desired wafer boats are thus loaded into the cantilever tube, it is inserted into the hot zone of the furnace. After suitable processing at elevated temperatures in the diffusion furnace, the cantilever tube is withdrawn from the furnace by means of the carriage mechanism. The reverse process is performed to cause the wafer boat carrying platform to be elevated through the elongated slot to lift the last loaded wafer boat above the inner surface of the cantilever tube and then laterally move it outside of the cantilever tube and, after removal of that wafer boat from the wafer boat carrying platform, the remaining wafer boats are similarly removed from the cantilever tube.

In one embodiment of the invention, a plurality of wafer loading stations, each including a slotted cantilever tube and a supporting carriage mechanism and a track upon which that carriage mechanism laterally moves, are positioned adjacent to each of a plurality of stacked diffusion furnaces. A computer controlled robotic mechanism carries the boat carrying platform to load or unload predetermined wafer boats in predetermined portions of the various cantilever tubes. The robotic mechanism also carries wafer boats to and from a shelf assembly for temporary storage of wafer boats which are to be loaded into a cantilever tube or which have just been unloaded from a cantilever tube.

In another embodiment of the invention, a laterally movable carriage mechanism includes a vertically movable guide block to which the door plate clamping mechanism is attached to achieve vertical lifting of the cantilever tube in response to rotation of a cam. The guide block's vertical path is determined by a roller attached to the guide block and which moves on a vertical guide surface for a first portion of the first vertical downward displacement of the cantilever tube in order to effectuate a "soft landing" of the cantilever tube inside the diffusion furnace, to position the cantilever tube on the bottom of the diffusion furnace and thereby avoid sagging of the cantilever tube at extremely high temperatures inside the hot zone of the diffusion furnace. During a second portion of the downward displacement during the "soft landing" of the cantilever tube, the vertical guide surface slopes slightly, causing the guide block to tilt slightly, lowering the distal open end of the cantilever tube relative to the proximal end thereof. This causes the distal end of the cantilever tube to rest on the bottom surface of the furnace before the proximal end does, thereby avoiding excessive stresses that would otherwise occur at the mouth or proximal end of the cantilever tube where it first contacts the edge of the mouth of a diffusion furnace tube.

In another embodiment of the invention, the wafer boats have short legs that are larger than the thickness of the wall of the cantilever tube. The wafer boats rest on these legs, which extend through the elongated slot of the cantilever tube and set on the bottom surface of the diffusion furnace tube when the cantilever tube is initially lowered. The cantilever tube then is withdrawn. This system achieves frictionless loading and unloading of the wafer boats and maintains a controlled gaseous atmosphere for the wafers during the entire wafer boat loading and unloading process.

In another described embodiment of the invention, the gas feed to the diffusion furnace tube is at its distal end, via a pigtail connection to the gas source. An interior gas exhaust tube is provided at the proximal end of the cantilever tube. The cantilever tube has two flanges at its proximal end, a first flange for supporting the cantilever tube and a second flange spaced from the first flange for abutting and sealing with the diffusion furnace. The interior exhaust tube extends through the wall of the cantilever tube between the first and second flanges to allow the exhausted gases to be collected by a conventional scavenger. An interior bypass tube of substantially smaller inside diameter than the interior exhaust tube opens into the interior exhaust tube inside the cantilever tube and passes around the location of the second flange and through the wall of the cantilever tube on the opposite side of the second flange. Some of the processing gases fed into the diffusion furnace tube via the pigtail connection pass through the cantilever tube and the rest passes between the cantileve tube and the diffusion furnace tube in approximately the same ratio as the inside diameters of the interior exhaust tube and the interior bypass tube and are exhausted to the scavenger.

DESCRIPTION OF THE INVENTION

Figures 1, 2, 3:
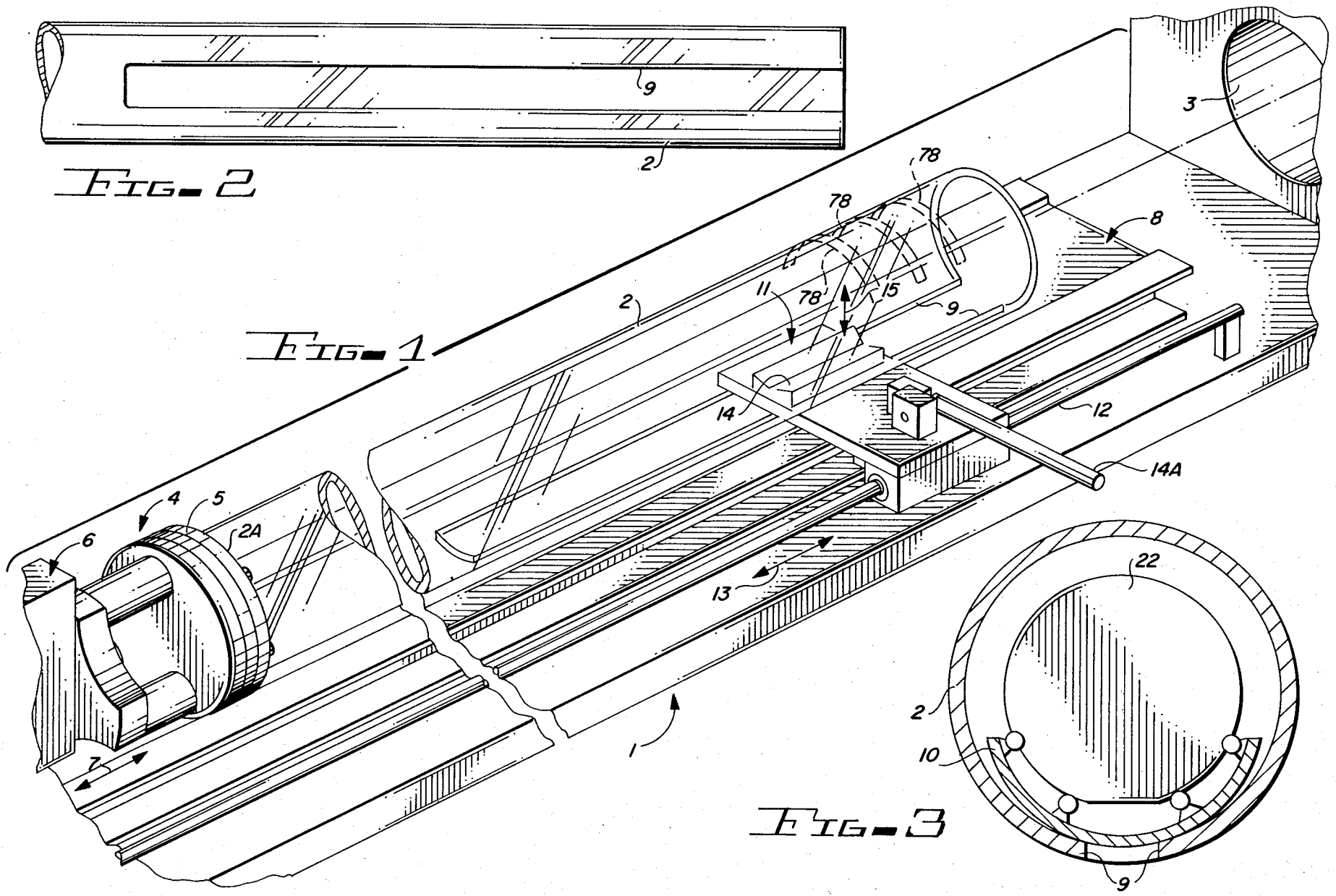
FIG. 1 is a partial perspective view illustrating a basic manually operated embodiment of the cantilever tube system of the present invention and a wafer boat loading mechanism therefore.
FIG. 2 is a partial bottom view of the elongated slot in the bottom of a cantilever tube shown in FIG. 1.
FIG. 3 is a section view of the cantilever tube of FIG. 1 with a loaded wafer boat therein covering the elongated slot.

Referring now to FIG. 1, a simplified manual cantilever diffusion tube system that we have constructed and tested is illustrated and designated by reference numeral 1. Cantilever diffusion tube system 1 includes a cantilever tube 2 that is supported at its left end in a manner entirely similar to that described in detail in the above-mentioned Wollman application. The right-hand end of cantilever tube 2 is open. Cantilever tube 2 typically is constructed of quartz, polycrystalline silicon or silicon carbide. As described in the above-referenced Wollman application, cantilever tube 2 can carry a number of wafer boats, each typically loaded with 50 to 75 semiconductor wafers, into a diffusion furnace tube 3.

A clamping mechanism 4 tightly seals the open right-hand end of cantilever tube 2 and supports it by means of a quartz flange 5 of antilever tube 2 and a clamp ring 2A. Reference numeral 6 generally designates a movable carriage mechanism that moves laterally in the directions of arrows 7 along a track 8. Means for producing a suitable flow of reactant gas or purging gas through cantilever tube 2 are omitted for convenience of illustration (since they do not constitute the main focus of the present invention). Such means are disclosed and described in detail in the above-referenced Wollman application, Serial No. 499,915.

A primary difference between the present invention and the system disclosed in the above-referenced Wollman application is the provision of a longitudinal, elongated, rectangular loading slot 9 in the right-hand bottom portion of cantilever tube 2 to effectuate loading of wafer boats (such as wafer boat 10 in FIG. 3) into cantilever tube 2. The side window and cover disclosed in the above-referenced Wollman application are omitted in the embodiments of the invention shown herein.

In accordance with a basic manually operated embodiment of the present invention shown in FIG. 1, a boat carrier mechanism 11 is supported on and is laterally movable along a linear rail 12 in the directions indicated by arrows 13. Boat carrier mechanism 11 includes a boat carrier platform 14 which is narrow enough and tall enough that it can extend upward through loading slot 9 to effectuate loading and unloading of wafer boats such as 10 into and out of cantilever tube 2.

A handle 14A is provided on boat carrier mechanism 11 to effectuate the lateral movement in the directions of arrows 13 along linear rail 12, and also to effectuate raising and lowering of the remote end of boat carrier mechanism 3 in the directions indicated by arrows 15.

Figure 5:
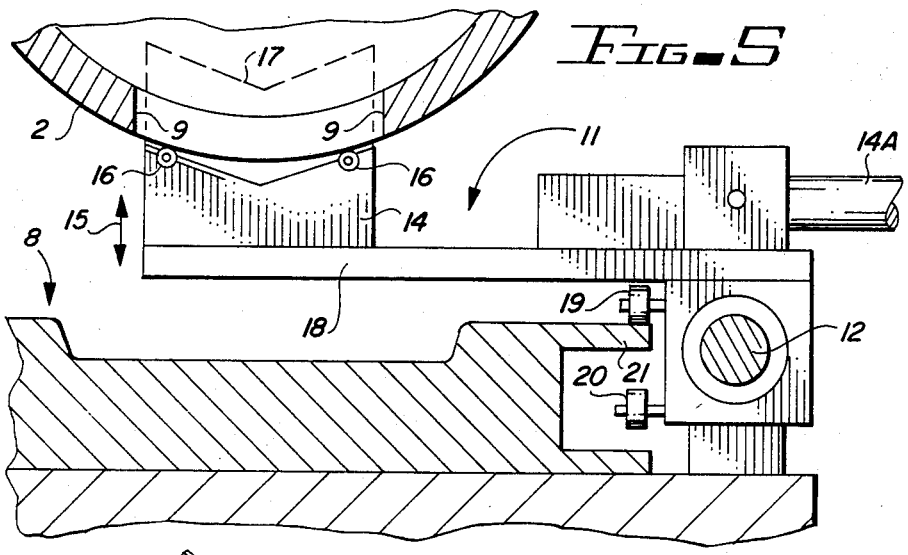
FIG. 5 is a partial section view illustrating details of the boat loading mechanism shown in FIG. 1.

At this point, it will be helpful to refer to FIG. 5 for an explanation of some salient features of boat carrier mechanism 11. First, boat carrier platform 14 has two elongated quartz rollers 16 which directly contact the semicylindrical bottom surface of quartz boat 10, since it is important to avoid quartz-to-metal contact which would result if the bottom of quartz boat 10 rests on the metal base of boat carrier platform 14.

The solid lines in FIG. 5 indicate the position of boat carrier 14 in its lowered position. Dotted lines 17 indicate the position of the upper surface of boat carrier platform 14 in its highest position, extending through boat loading slot 9 of cantilever tube 2. At this point, it can be seen that the support arm 18 on which boat carrier platform 14 is supported pivots about linear rail 12 in response to downward movement of the outer end of handle 14A. Rollers 19 and 20 contact the upper and lower surfaces, respectively, of flange 21 on the left hand side of track 8 to define the limits of the elevated and lowered positions of boat carrier platform 14.

It is noteworthy that the arrangement of the wafer boats such as 10 and wafers such as 22 in cantilever tube 2, as shown in FIG. 3, is such that the wafers 22 are precisely centered in cantilever tube 2 and wafer boat 10 is very close to the bottom wall of cantilever tube 2, and results in very uniform flow of resistant gases through the wafers 22, resulting in improved uniformity of processing of the wafers and improved wafer yield.

Figure 6A:
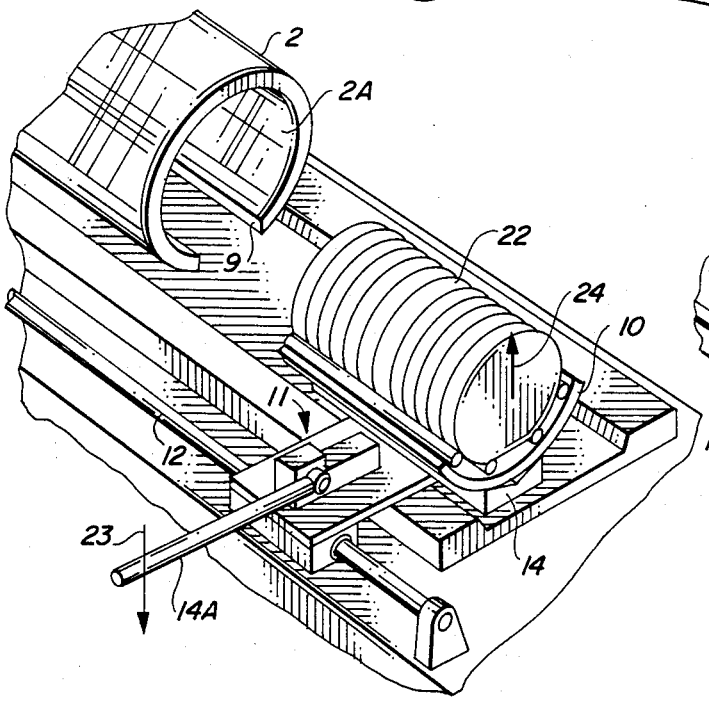
FIGS. 6A and 6B are partial perspective views of the system of FIG. 1 useful in explaining the operation thereof.

Next, the operation of the wafer boat loading system of FIG. 1 will be explained with reference to FIGS. 6A and 6B. The first step in the wafer loading procedure is to place wafer boat 10, loaded with wafers 22, on boat carrier platform 14 of boat carrier mechanism 11, as shown in FIG. 6A, when boat carrier mechanism 11 is positioned to the right of and aligned with the open end 2A of quartz cantilever tube 2. Handle 14A is then pressed downward in the direction of arrow 23, thereby lifting boat 10 and wafers 22 upward in the direction of arrow 24 as mechanism 11 pivots about linear rail 12. The lower roller 20 (FIG. 5) is positioned so that when it strikes the bottom surface of flange 21, the cylindrical bottom surface of wafer boat 10 is positioned above the inner bottom surface of cantilever tube 2A. Boat carrier platform 14 is tall enough and narrow enough that it will extend through slot 9 in the bottom of cantilever tube 2, holding the bottom of wafer boat 10 above the inner bottom surface of cantilever tube 2. Support arm 18 remains below the bottom outer surface of cantilever tube 2.

Figure 6B:
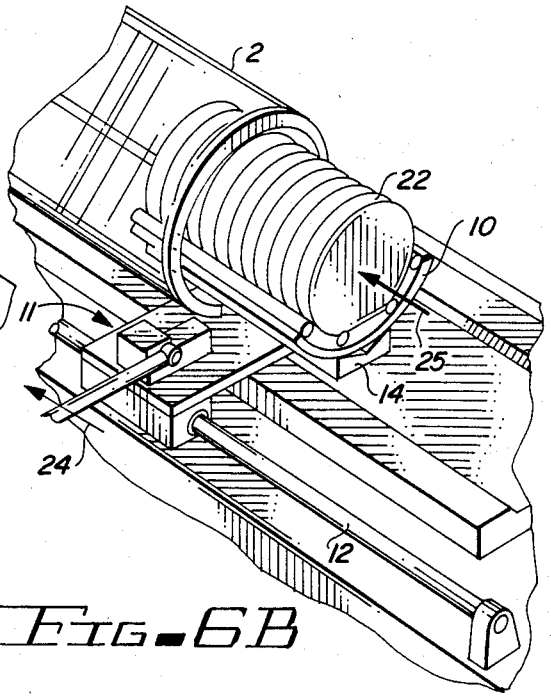

The operator moves handle 14A to the left in the direction of arrow 24 in FIG. 6B, maintaining boat carrier platform 14, wafer boat 10, and wafers 22 in their elevated positions, causing them to move into the interior of cantilever tube 2 in the direction of arrow 25. Preferably, the boat carrier mechanism 11 is moved far enough to the left that the bottom of the first wafer boat 10 covers the right-hand end of elongated slot 9.

Although not illustrated in FIG. 6A and FIG. 6B, the next sequence of steps are the reverse of those just described. More specifically, handle 14A is raised, causing the bottom outer surface of the wafer boat to be lowered onto the inner edges of slot 9, thereby covering that portion of the slot 9 and effectively sealing it from the outside. Boat carrier mechanism 11 is then moved to the right, in the direction opposite to arrow 24 of FIG. 6B, and is moved beyond the right hand end of cantilever tube 2. Another wafer boat load of unprocessed wafers then is in positioned on boat carrier platform 14, and the process is repeated.

Figure 4:
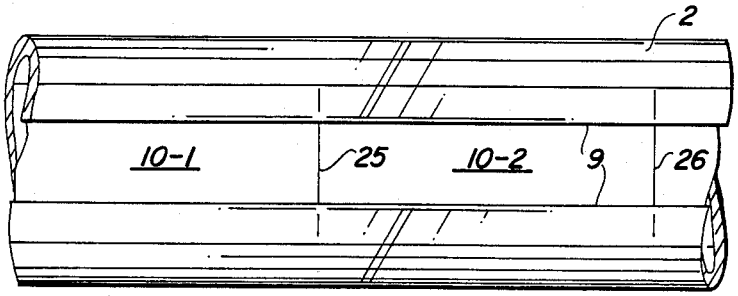
FIG. 4 is a partial bottom view of the cantilever tube shown in FIG. 1 with a plurality of wafer boats therein covering and sealing the elongated slot.

At this point, it should be noted that the end edges of the wafer boats 10 are precisely flat and vertical, so that wafer boats which are consecutively loaded inside of cantilever tube 2 precisely abut each other so that there are no uncovered gap of slot 9 between wafer boats. For example, in FIG. 4, the lines designated by reference numerals 25 and 26 show that the abutting end edges of the wafer boats loaded in cantilever tube 2 effectively seal the elongated bottom loading slot 9.

It should also be noted that boat carrier platform 14 can be long enough to carry a plurality of loaded wafer boats, so than an entire "run" of wafer boats can be loaded or unloaded in one operation. It should also be noted that an unloaded wafer boat or "dummy" boat can be loaded into the cantilever tube to close or seal part of the length of loading slot 9.

After all of the wafer boats for a particular processing run have been loaded into cantilever tube 2, it is moved to the right in the direction of arrow 13 (FIG. 1) into diffusion tube or furnace 3 for processing. After the high temperature wafer processing steps have been completed, as described in more detail in the above-referenced Wollman application, then the cantilever tube 2 is withdrawn in the manner described in the Wollman application, and the wafer boats 10 are removed using boat carrier mechanism 11 in a manner entirely analagous to that described above, except the order of the steps is reversed.

More specifically, the boat carrier mechanism 11 is positioned underneath tube 2 so that the boat carrier 14 is positioned beneath the loaded wafer boat nearest the open end 2A of cantilever tube 2. The boat carrier platform is raised to engage the bottom of that wafer boat, lift it above the edges of the loading slot 9, and the mechanism 11 is moved in the direction opposite to arrow 25 in FIG. 6B to remove that wafer boat from the cantilever tube 2. The wafer boat is then removed by suitable means, and the same procedure is repeated to remove the remaining loaded boats of processed wafers.

Figure 9:
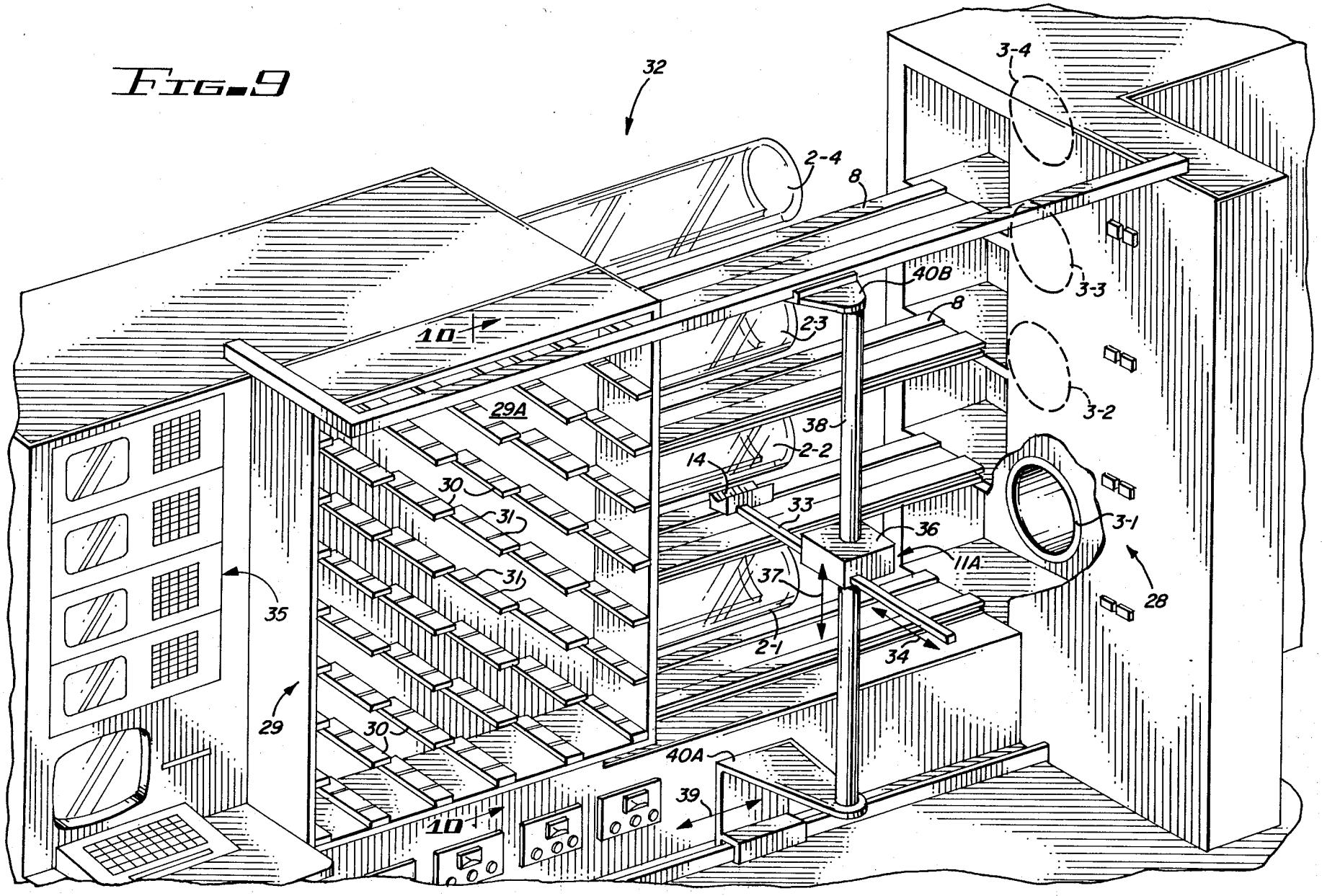
FIG 9 is a partial perspective view of an automatic wafer boat loading system incorporating a plurality of cantilever tubes and carriage mechanisms of the type shown in FIG. 1.
Figure 10A:
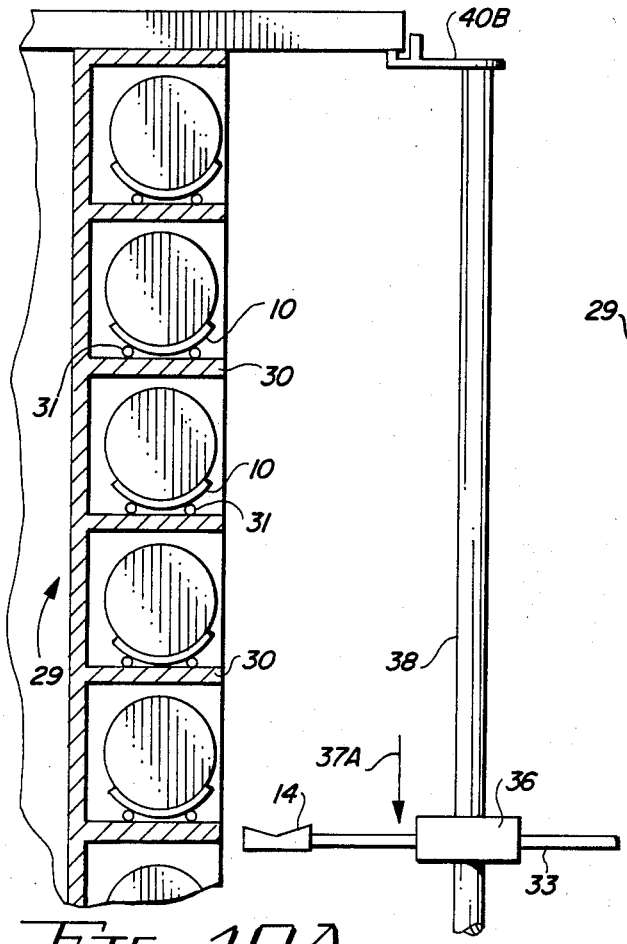
FIGS. 10A–10E are partial section views useful in explaining the operation of the automatic system shown in FIG. 9.

Next, a more complex embodiment of the invention is described with reference to FIG. 9, wherein the basic concept described above with reference to FIG. 1 is implemented in conjunction with a "stack" of diffusion furnaces designated by reference numeral 28, which shows four diffusion furnaces 3-1, 3-2, 3-3 and 3-4 vertically stacked in a conventional manner well known to those skilled in the art. Four separate "loading stations" are positioned adjacent to the right hand ends of the respective diffusion furnaces 3-1, 3-2, . . . 3-4. Each of those diffusion loading stations includes a cantilever tube such as cantilever tube 2 described above with reference to FIG. 1. In FIG. 9, these four cantilever tubes are designated by reference numerals 2-1, 2-2, 2-3 and 2-4. Each is supported on a track such as 8 in FIG. 1, and each of the cantilever tubes 2-1, 2-2, etc. is supported in cantilever fashion by a flange on its left end by carriage mechanism (not shown in FIG. 9) which effectuates precise insertion and withdrawal of the respective cantilever tubes into the respective diffusion furnaces 3-1, 3-2, etc.

A wafer boat storage rack 29 is positioned adjacent to the left end of the above-described loading regions. Wafer boat rack assembly 29 includes a plurality of boat supporting arms or shelves such as 30 which are supported on their rear ends by a rear wall 29A of wafer boat rack assembly 29. Each of the wafer boat shelves 30 has two quartz rods, such as 31 on its upper surface for supporting the bottom surfaces of two adjacent loaded wafer boats, such as 10 previously described with reference to FIG. 3, FIGS. 6A and 6B.

In wafer boat rack assembly 29, there are two rows of the wafer boat shelves 30 corresponding to each of the four cantilever tube wafer boat loading stations. One of the rows of wafer boat shelves 30 is reserved for supporting wafer boats loaded with unprocessed semiconductor wafers such as 22, and the other row of wafer boat shelves 30 is reserved for supporting boats loaded with wafers that have just been removed from one of the cantilever tubes 2-1, 2-2, etc.

The computerized diffusion furnace loading system 32 of FIG. 9 includes a boat carrier robot mechanism designated by reference numeral 11A. Boat carrier robot 11A includes a boat carrier platform 14 substantially identical to the one described with reference to FIGS. 1, 5, 6A and 6B. However, boat carrier platform 14 in FIG. 9 is supported by a horizontal arm 33 which can be automatically moved in the directions indicated by arrows 34 in response to a furnace loading/unloading program stored in and executed by computer 35. Movable horizontal arm 33 is supported by and controlled by a moving block 36 containing a suitable mechanism such as a stepper motor responsive to programmed computer 35 for precisely controlling the position of arm 33 and boat carrier platform 14. The vertical position of moving block 36, and hence of horizontal arm 33, is adjusted by vertical movement of moving block 36 in the direction of arrows 37 on a vertical rod 38. A suitable mechanism such as a stepper motor is contained in moving block 36 to engage vertical rod 38 and precisely vertically position boat carrier platform 14.

Note that the directions of arrows 34 are transverse to the longitudinal axes of the cantilever tubes 2-1, 2-2, etc. The movement of boat carrier platform 14 in the direction parallel to the longitudinal axes of cantilever tubes 2-1, 2-2, etc. in the directions of arrows 39 is controlled by a suitable lateral displacement mechanism including carriage guide elements 40A and 40B. Again, suitably positioned stepper motors and a satisfactory cable or screw gear arrangement can be readily provided by those skilled in the art to achieve precise positioning of the position of vertical rod 38, moving block 36, and carriage guide elements 40A and 40B in the directions of arrows 39 in response to computer 35. The movement of boat carrier platform 14 in the directions of arrows 34, 37, and 39 allows boat carrier platform 40 to lift any wafer boat that is supported by wafer boat shelves 30 in rack assembly 30 to be automatically loaded in a selected one of the cantilever tubes 2-1, 2-2, etc. in a manner entirely analogous to that previously described with reference to FIGS. 6A and 6B so that all of the wafer boats initially loaded into wafer boat rack assembly 29 eventually are loaded into the four cantilever tubes 2-1 . . . 2-4. The cantilever tubes then, under the control of computer 35, are inserted into the four diffusion furnace tubes 3-1 . . . 3-4. After processing in the high temperature zones of diffusion tubes is complete, the cantilever tubes with wafer boats therein are withdrawn, and the boat carrier robot 11A is operated in response to computer 35 to unload all of the processed wafers and wafer boats supporting them, one by one, and place them on the appropriate shelves of wafer boat rack assembly 29.

Figure 12:
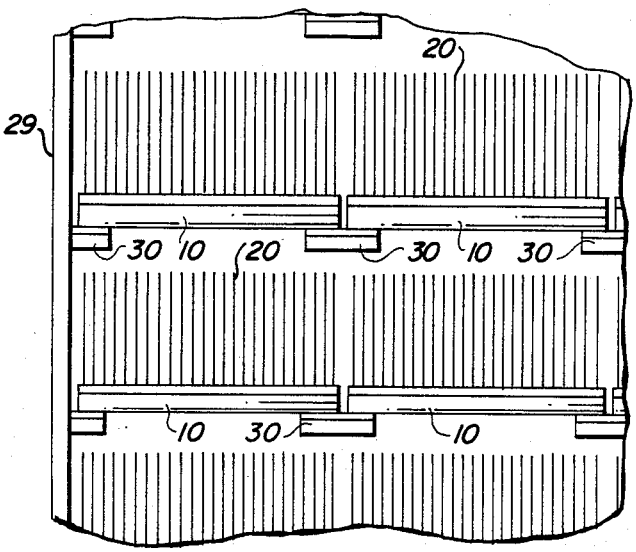
FIG. 12 is a partial front view of the wafer boat rack portion of the system shown in FIG. 9.

FIG. 12 shows a partial view of the front of wafer boat rack assembly 29 with each of the wafer boat or shelves 30 supporting opposite ends of a loaded wafer boat 10. The dimension of boat carrier platform 14 in the horizontal direction is short enough that it can fit between two adjacent wafer boat shelves 30 and thereby pick up or deposit a wafer boat 10 loaded with wafers 20.

Figure 11:
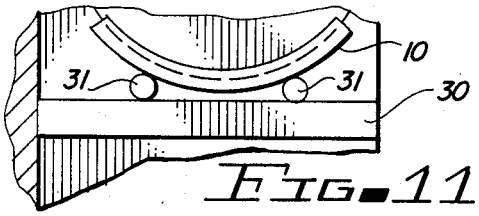
FIG. 11 is a partial section view useful in explaining one aspect of the system of FIG. 9.

The section view of FIG. 11 shows how one of the wafer boat shelves 30 supports a wafer boat 10 on two of the quartz rods 31 mentioned above.

Figure 10B:
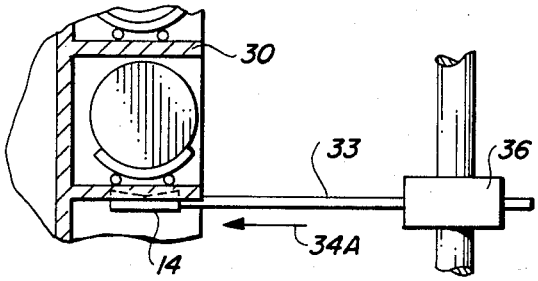
Figure 10D:
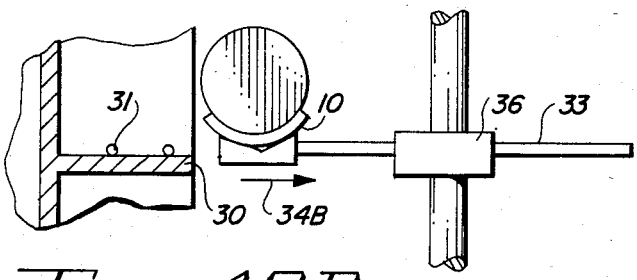
Figure 10C:
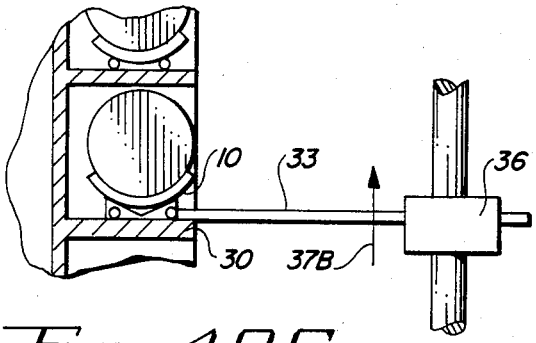

FIGS. 10A–10E illustrate more precisely the sequence of steps and displacements undergone by boat carrier robot 11A of FIG. 9, and more particularly, moving block 36 thereof. In response to computer 35 to effectuate loading and unloading of wafer boats into or out of wafer boat rack assembly 29. For example, in FIG. 10A, moving block 36 causes boat carrier platform 14 to move downward in the direction of arrow 37A to align it with a particular row of the wafer boat shelves 30. Then, as indicated in FIG. 10B, arm 33 moves to the left in the direction of arrow 34A to position boat carrier platform 14 between two of the shelves 30 immediately beneath a particular wafer boat 10. Then, as indicated in FIG. 10C, the moving block 36 and arm 33 move up in the direction of arrow 37B to lift platform 14 and wafer boat 10 upward off of shelf 30. Next, as indicated in FIG. 10D, the arm 33 is moved to the right in the direction of arrow 34B, removing the wafer boat 10 from the shelf 30. Finally, the moving block 36 is moved in the both the horizontal and vertical directions as needed to align that wafer boat 10 at the right end of the open end of a selected one of the four cantilever tubes 2-1, 2-2, etc. and load that wafer boat into the selected cantilever tube.

Figure 10E:
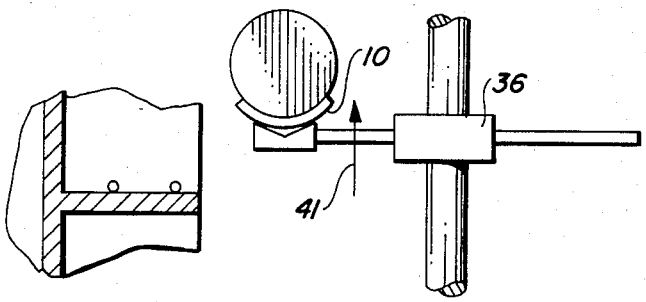
Figures 13A, 13B, 14A, 14B, 14C, 14D, 15:
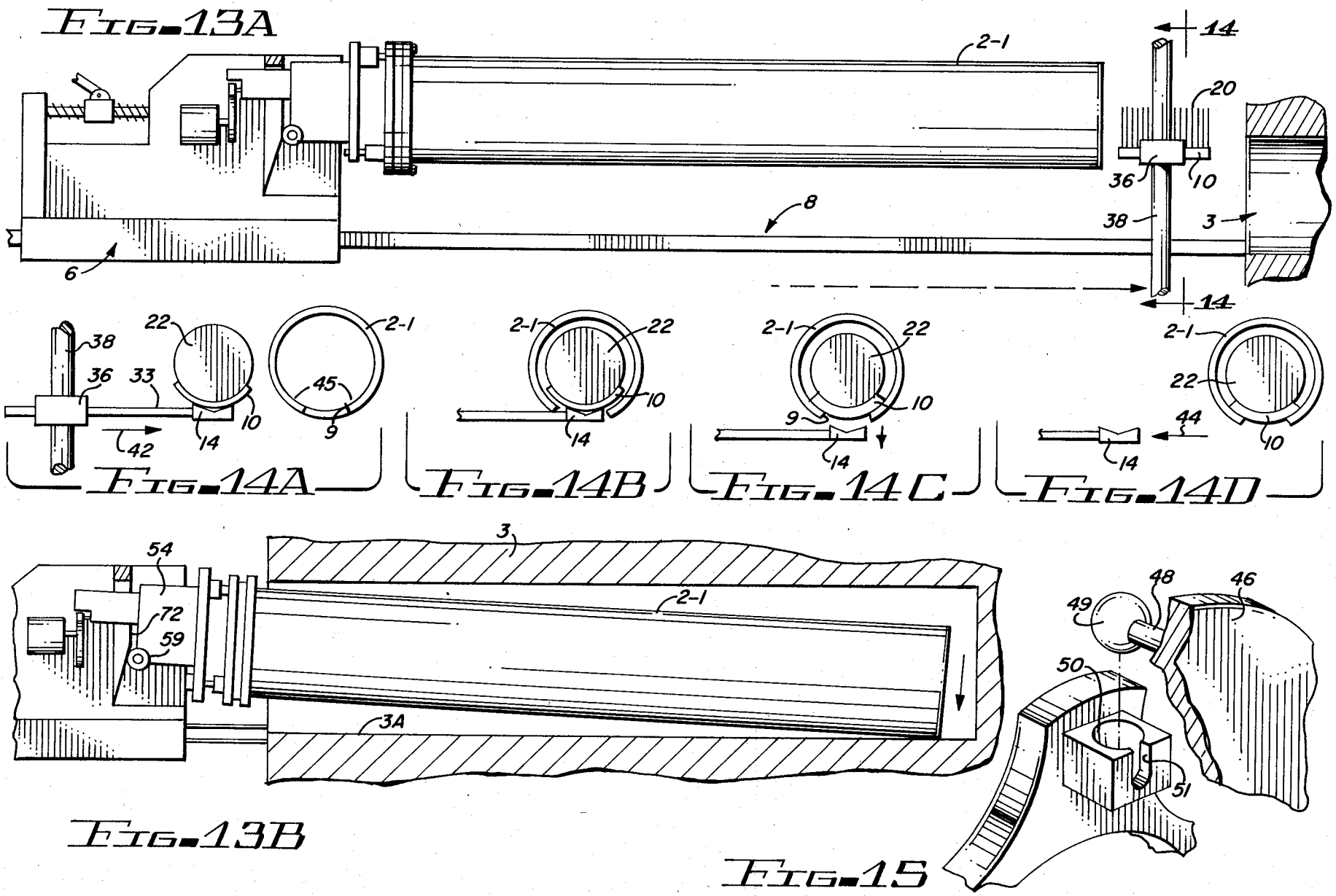
FIGS. 13A and 13B are diagrams useful in explaining the operation of the "soft landing" carriage mechanism illustrated in FIG. 7.
FIGS. 14A–14D are section diagrams useful in explaining the operation of the system shown in FIG. 9.
FIG. 15 is an enlarged partial perspective diagram of a quick release attachment mechanism used in the "soft landing" system illustrated in FIG. 7.

A procedure for loading the wafer boat 10 shown in FIG. 10E into a particular one of the cantilever tubes, for example cantilever tube 2-1, is entirely analogous, and is illustrated in FIGS. 14A–14D. In FIG. 14A, moving block 36 causes arm 33 to move in the direction of arrow 42 to align wafer boat 10 so that its bottom surface is above the inner surface 45 of cantilever tube 2-1, after the computer 35 has caused moving block 36 to be vertically and horizontally positioned to the right (FIG. 9) of the open end of cantilever tube 2-1. Then, with the wafer boat 10 and wafers 20 thus aligned, the carriage elements 40A and 40B (FIG. 9) are moved to the left, as shown in FIG. 14B, causing the boat 10 and wafers 20 to be moved to a selected position within cantilever tube 2-1, platform 14 extending through the elongated loading slot 9 to support boat 10 above the bottom of the cantilever tube. Then, as indicated in FIG. 14C, the moving block 36 causes the arm 33 and platform 14 to be lowered in the direction of arrow 43. Finally, the platform 14 is withdrawn in the direction of arrow 44, as indicated in FIG. 14D.

At this point, it should be appreciated that the above described structures and techniques for effectuating loading and unloading of wafers into and out of cantilever tube 2 overcome many difficulties and objections associated with the above mentioned prior techniques of loading wafers through a side window in a cantilever diffusion tube, as described in the above-referenced Wollman application. The technique of providing the loading slot 9 and utilizing a boat support platform 14 that extends through this loading slot, and utilizing precisely semicylindrical outer surfaces and precisely flat, mating end surfaces of the various wafer boats to seal the elongated loading slot 9, has proven to be highly satisfactory. It reduces generation of quartz dust due to friction, because the rollers 31 of the wafer support boat 14 never make any sliding contact with the wafer boats. The axial movement of the boat carrier mechanism 11, whether manually or robotically controlled, is simple and relatively convenient, compared to the complexity of designing and constructing an automatic or robotic boat loading system that would pass the wafer boats through a side window of the cantilever tubes.

Next, a further improvement to the carriage mechanism 6 referred to above and disclosed in more detail in the above-referenced Wollman application will be described, with reference to FIGS. 7, 8A, 8B, 13A, 13B, and 15.

Figure 7:
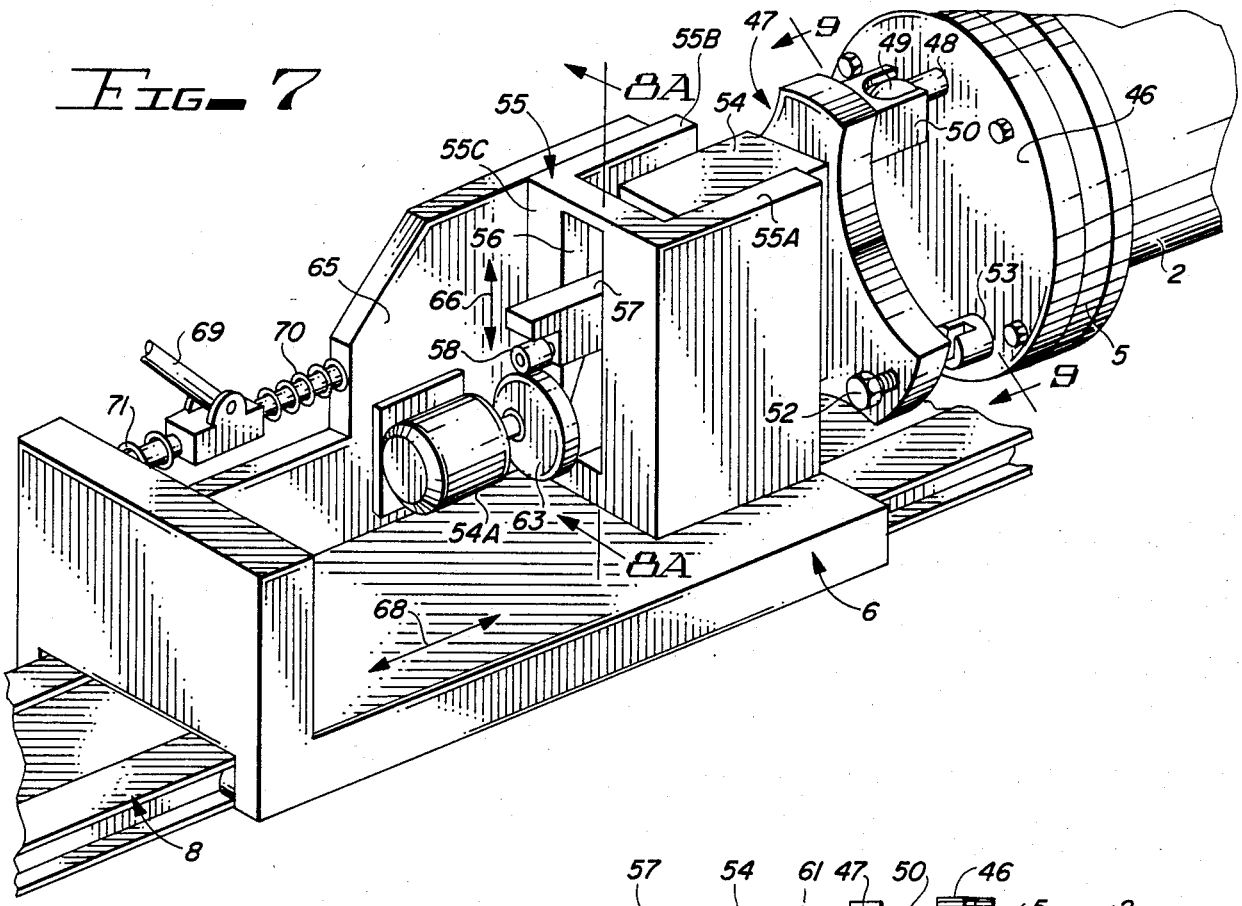
FIG. 7 is a partial perspective view illustrating a "soft landing" carriage mechanism for supporting the cantilever tube shown in FIG. 1.

Referring now to FIG. 7, carriage 6 rides on track 8 in a manner entirely analogous to that described in the above-referenced Wollman application. Cantilever tube 2 has a flange 5, as described in detail in the Wollman application, and a clamping mechanism by means of which a solid door 46 is sealably engaged with the outer vertical face of flange 5 to seal the entire cantilever tube 2. Suitable quick release gas connectors (not shown) are provided to pass reactant gases through door 46. A three point adjustable quick release, adjustable connection is provided to allow adjustment and alignment of cantilever tube 2, with door 46 attached thereto from a "spider" 47 which supports the tube 2 in cantilever fashion. A post 48 is connected to the upper face of door 46, and has a ball 49 rigidly attached thereto. An open top socket 50 receives ball 49. Socket 50 has a narrow vertical groove 51 which accomodates shaft 48 that prevents lateral withdrawal of ball 49 from socket 50. On the lower two arms of the triangular "spider" 47, suitable adjustment means 52 are provided which engage thrust bearing members 53 attached to the lower portions of door 46 to effectuate very precise alignment of the axis of cantilever tube 2 with the axis of the diffusion furnace 2 into which cantilever tube 2 is to be inserted.

The back face of spider 47 is attached to a rigid guide block 54. Guide block 54 is supported inside a U-channel 55. U-channel 55 has two sides 55A and 55B and a back side 55C. Back side 55C has a vertical slot 56 therein. A cam follower member 57 rigidly attached to the back face of guide block 54 extends through slot 56. A cam follower roller 58 is attached to the outer end of cam follower member 57.

Guide block 54 is supported by means of two rollers 59 attached to the bottom rear corner portions of guide block 54 so that they roll on the inner surface 60 of back wall 55C of U-channel 55. On opposite sides of guide block 55 are rollers 61 which extend into corresponding vertical slots 62 disposed in the inner surfaces of side walls 55A and 55B.

Cam follower roller 58 rides on an eccentric cam 63 which is driven by a cam motor 54. Cam motor 54 is rigidly attached to a back wall member 65 of carriage 6.

Figure 8A:
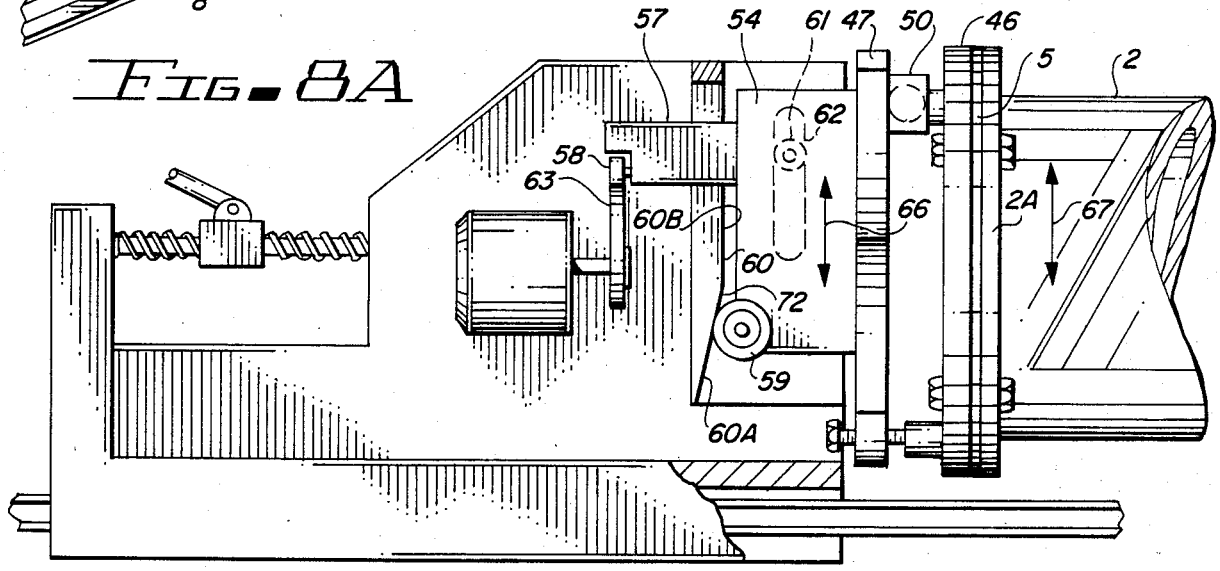
FIG. 8A is a partial elevation view of the mechanism shown in FIG. 7.

Thus, when cam 63 rotates, it causes vertical movement of cam follower member 57 in the directions indicated by arrow 66 which, in turn, causes corresponding vertical motion of spider 47, socket 50, door plate 46 and ultimately cantilever tube 2 in the direction of arrows 67 (FIG. 8A). Lateral movement of carriage 6 along track 8 in the direction of arrows 68 is achieved by means of a mechanism 69 which is coupled by means of two compression springs 70 and 71. Mechanism 69 is connected to a drive device, which is not shown, but can be readily provided by those skilled in the art.

Figure 8B:
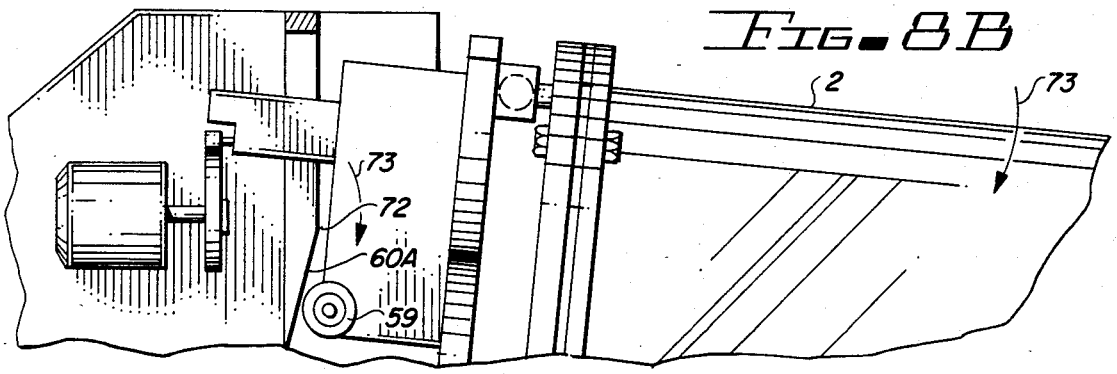
FIG. 8B is a partial elevation view useful in describing the operation of the mechanism of FIG. 8A.

In accordance with a "soft landing" aspect of the present invention, the lower portion 60A of the inner surface 60 of the back wall 55C of U-channel 55 is slightly sloped, as shown in exaggerated fashion in FIGS. 8A and 8B, and also FIGS. 13A and 13B. It can be seen that the upper portions of the travel of guide block 54 in the directions of arrows 66 are precisely vertical, since the upper portion 60B of surface 60 is perfectly vertical. However, during downward travel of guide block 56, when rollers 59 pass downward over the knee 72 of surface 60, the guide block 54 begins to tilt slightly, causing an arcuate movement 73 (FIG. 8B) of cantilever tube 2.

Once a cantilever tube such as 2-1 (FIGS. 13A and 13B) is positioned within a diffusion furnace tube 3, it is very desirable to be able to lower the entire cantilever tube 2-1 onto the bottom inner surface 3A of the furnace tube 3 if the processing temperatures in the hot zone of the furnace 3 are above approximately 1050° Centigrade, in order to avoid gradual sagging of the material of which the cantilever tube 2-1 is composed (typically quartz, polycrystaline silicon or silicon carbide).

At this point, it should be appreciated that if the arcuate motion indicated by arrow 73 in FIG. 8B does not occur during the "soft landing" operation of lowering cantilever tube 2-1 to the bottom inner surface 3A of diffusion furnace tube 3, then it is possible that the left end portion, rather than the right end portion of cantilever tube 2-1 might first engage the edge bottom surface 3A of diffusion furnace tube 3 near the mouth of furnace tube 3. It should be apreciated that this situation would likely result in a very large amount of stress in both the quartz material near the mouth of diffusion furnace tube 2 and also the corresponding contacting portion of cantilever tube 2-1. This could result in fracturing and breakage of the diffusion tube 3 or the cantilever tube 2-1, and/or generation of defect-producing quartz dust.

Therefore, it should be apparent that it is highly desirable to provide a means for first lowering the right hand end of cantilever tube 2-1 during a soft landing procedure. It should be apparent from the structure shown in FIGS. 3A and 3B and the diagram of FIG. 13B that the slightly sloped lower surface 60A on the inside back wall 55C of U-channel 55 accomplishes this desirable effect. As the cam 63 continues to rotate to lower guide block 54, the right hand end of cantilever tube 2-1 tilts downward as rollers 59 pass over the knee 72 of surface 60. After the right hand end of cantilever tube 2-1 rests on the bottom surface 3A of diffusion tube 3, further downward movement of guide block 54 as the cam 63 rotates results in continued downward movement of the left hand end of cantilever tube 2-1 until it also rests on surface 3A.

Figures 16, 17, 18A, 18B, 18C:
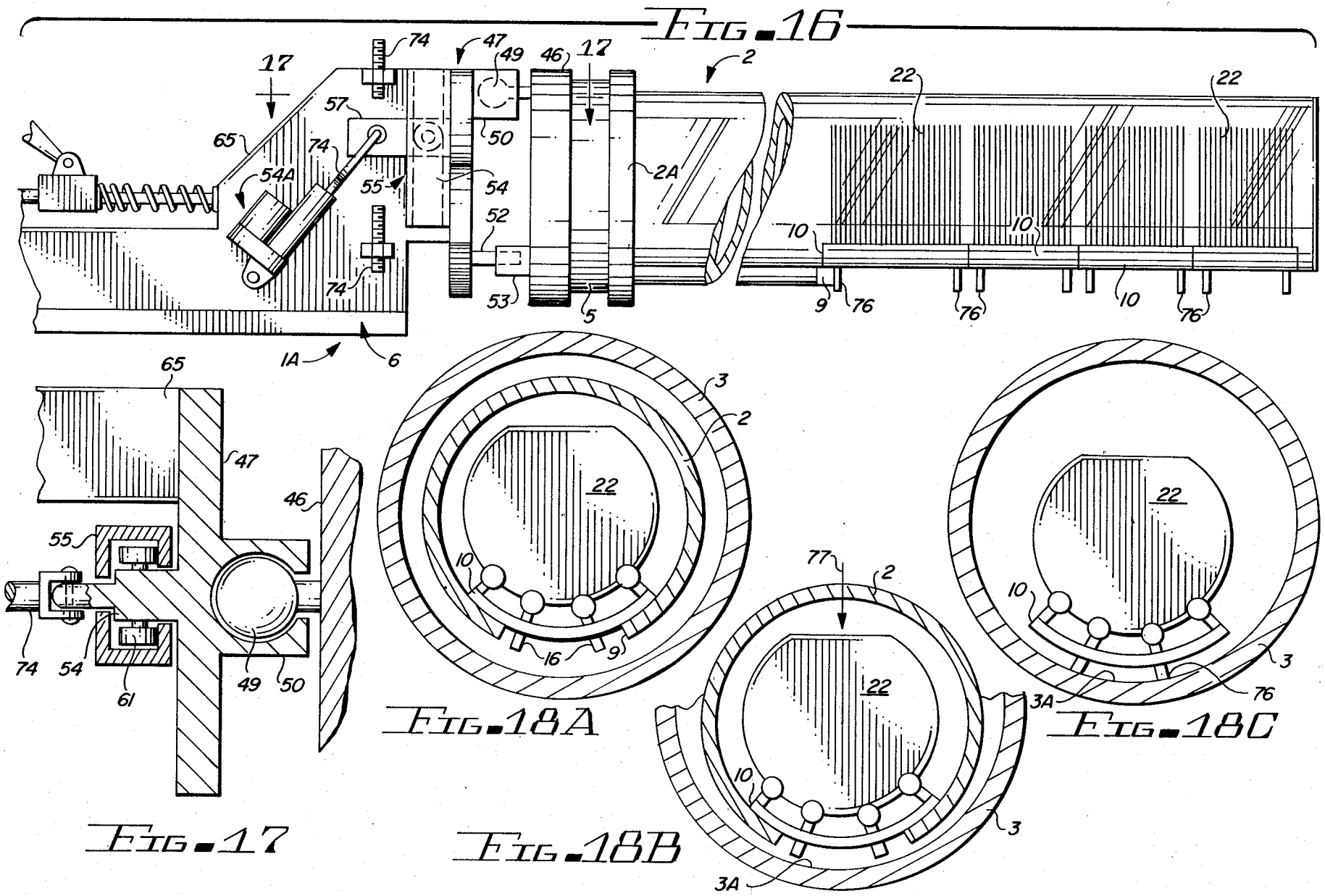
FIG. 16 is a side elevation view of another embodiment of the invention.
FIG. 17 is a partial section view along section line 17—17 of FIG. 16.
FIGS. 18A–18C are end view diagrams useful in describing the operation of the embodiment of the invention shown in FIG. 16.

Referring now to FIG. 16, modified cantilever diffusion tube system 1A provides a somewhat different implementation of the carriage 6, in that stepper motor 54A drives a jackscrew 74 which is connected to block 57, instead of driving a cam and cam-follower as illustrated in FIG. 7. Jackscrew 74 is connected to arm 57, which is rigidly attached to guide block 54. Guide block 54 moves within U-channel 55 to raise and lower spider 47, which supports door 46. Door 46 is clamped to cantilever tube 2 by means of clamping ring 2A and quartz flange 5 of cantilever tube 2. (Where appropriate, the same reference numerals are used in FIG. 16 and FIG. 17 as in FIG. 7.) Reference numeral 74 designates stops schematically depicted to control the upward and downward limits of movement of cantilever tube 2.

However, the most important aspects of FIGS. 16, 17 and 18A–18C relate to the provision of legs 76 on the bottom of each of the quartz boats 10. The legs 76 extend through the loading slot 9 of slotted cantilever tube 2, as illustrated. The length of each leg 76 is such that when the wafer boat is resting on the bottom surface of the cantilever tube 2 so as to effectively close the loading slot 9, legs 76 extend below the bottom outer surface of cantilever tube 2. Thus, when the mechanism of carriage 6 in FIG. 16 is operated so as to lower the cantilever tube 2 in the direction of arrow 77 in FIG. 18B, the legs 76 will eventually come to rest on the bottom surface 3A of diffusion tube 3 before the bottom surface of cantilever tube 2 touches bottom surface 3A.

By then lowering the diffusion tube a bit more, the carriage 6 can be withdrawn from the diffusion furnace tube 3 without touching it, boat 10, or legs 76, leaving the wafer boat 10 and wafers 22 therein positoned inside diffusion tube 3 as illustrated in FIG. 18C.

It can be seen that this approach can be very beneficial in extremely high temperature processes in which the diffusion tube 2 would tend to sag due to thermal creep of its material, because the previously mentioned advantages of providing a controlled ambiant atmosphere during both loading and unloading of the boatloads of wafers into the diffusion furnace tube 3 is unaffected. However, the benefits of providing "double wall" isolation between the wafers and the diffusion furnace tube are lost, so the diffusion furnace tube 3 may have to be cleaned more often, causing down time of the diffusion furnace. Nevertheless, for very high temperature processing operations, this option described with reference to FIGS. 16, 17 and 18A–18C can be very advantageous because of its ability to provide controlled gaseous ambiants during loading and unloading operations, while completely avoiding production of defect-producing particulate contaminants.

Figure 19:
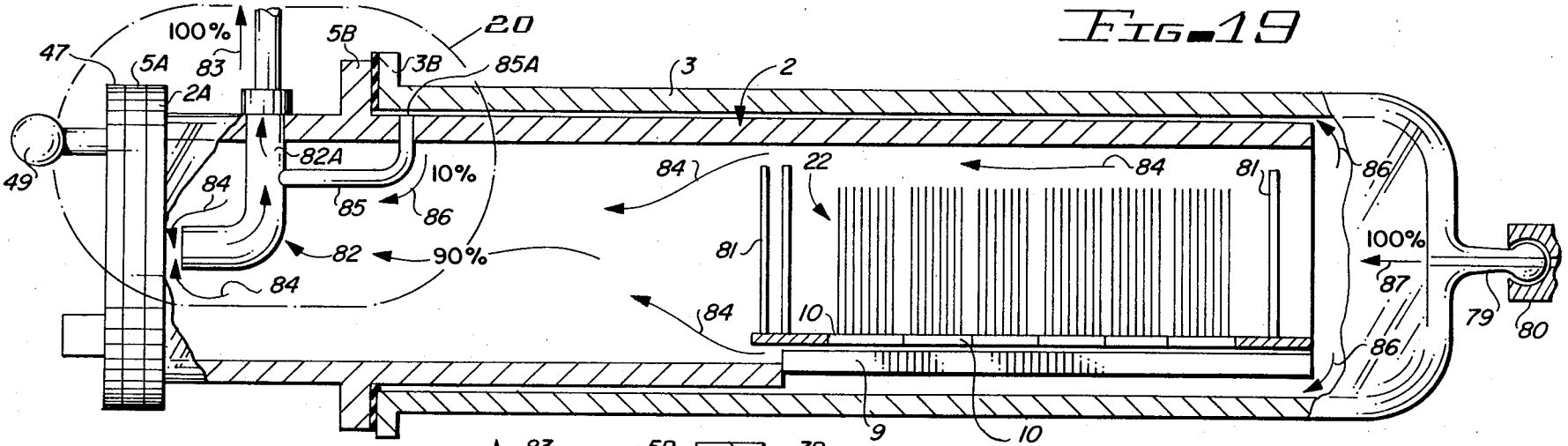
FIG. 19 is a section view of another embodiment of the invention.
Figure 20:
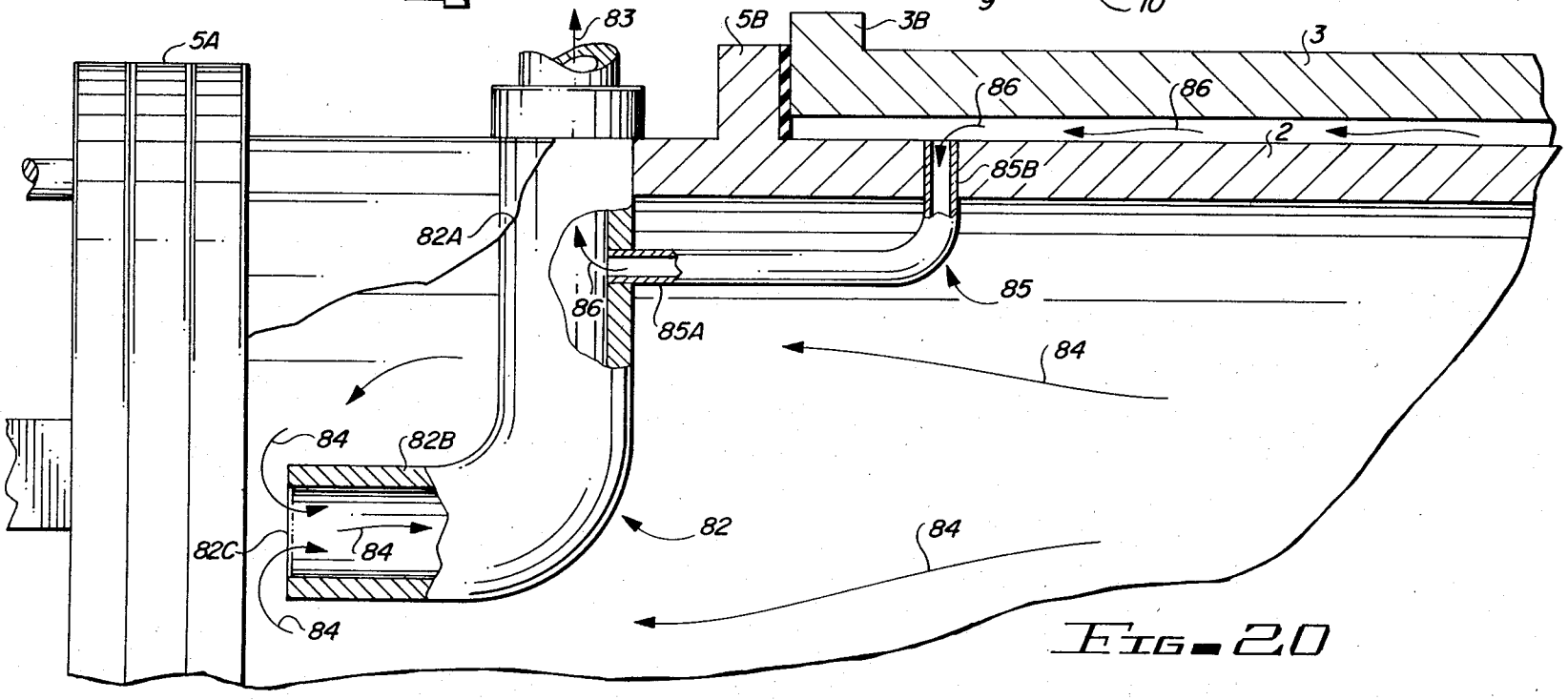
FIG. 20 is an enlargement of detail 20 of FIG. 19.

Referring next to FIG. 19, and also to FIG. 20, which is an enlargement of detail 20 of FIG. 19, an embodiment of the invention is shown which allows use of the cantilever tube 2 in a system in which the users do not wish to run gas connecting lines to the proximal or left hand side of the diffusion furnace tube 3, and instead prefer to feed reactant gases into the diffusion furnace tube 2 by means of a conventional "pigtail" such as 79 in FIG. 19. Reference numeral 80 designates a typical reactant gas line connector by means of which the reactant gas source is connected to the enlarged ball end of the pigtail 79 to form a seal therewith. Of course, purging gas can be caused to flow through the cantilevered tube 2 by means of connections (not shown) through the doorplate 47 during insertion and withdrawal of the cantilever tube 2 into the diffusion furnace 3.

In FIGS. 19 and 20, an interior exhaust tube 82 having the shape of an elbow has its upper end 82A extending through the upper wall of cantilever tube 2 at a location between a first flange 5A and a second flange 5B that is spaced several inches to the right of flange 5A for the purpose of abutting and forming a seal with the flange 3B of furnace diffusion tube 3. The lower portion 82B of interior exhaust tube 82 is approximately coaxially aligned with cantilever tube 2, and has an open end 82C into which reactant gases flowing from right to left in cantilever tube 2 can flow and be exhausted from cantilever tube 2 into a conventional scavenger unit. Scavengers are well known to those skilled in the art.

A typical insidse diameter of exhaust tube 82 can be approximately 25 millimeters.

An internal bypass tube 85 has an end 85A which opens into the interior passage of exhaust tube 82, and has another open 85B which passes through the upper surface of cantilever tube 2 on the right hand side of flange 5B. The inside diameter of bypass tube 85A is much less than that of exhaust tube 82, and can, for example, be approximately 6 millimeters.

For the diffusion furnace tube 3 as shown in FIGS. 19 and 20, the reactant gas source (not shown) causes a predetermined supply of reactant gas to flow into diffusion furnace tube 3 through pigtail connection 79, as indicated by arrow 87. A small amount of the reactant gas flows between the inner wall of diffusion furnace tube 3 and cantilever tube 2, as indicated by arrows 86. This portion (for example, about 10%) of the reactant gas eventually flows into the open end of 85A of bypass tube 85, and flows therethrough into the interior of exhaust tube 82. The remainder of the reactant gas, for example, approximately 90% of it, flows through diffusion tube 2 and between wafers 22 therein, as indicated by arrows 84. As also indicated by arrows 84, the reactant gas flowing through cantilever tube 2 eventually passes into the open end 82C of interior exhaust tube 82, and mixes with the gas 86 flowing through bypass tube 85, and is exhausted into the scavenger region, as indicated by arrow 83. The ratio of the reactant gas flowing between the cantilever tube 2 and the diffusion tube 3 is approximately the same as the ratio of the inside diameter of exhaust tube 82 to the inside diameter of bypass tube 85.

While the invention has been described with reference to several particular embodiments thereof, those skilled in the art will be able to make various modifications to the described embodiment of the invention without departing from the true spirit and scope thereof. However, it is intended that variations of the described apparatus and method there is equivalent to those described herein and that they accomplish substantially the same function in substantially the same way to obtain substantially the same result, within the scope of the invention. For example, for LTO (low temperature oxidation) systems, the cantilever tube 2 can be provided with semicircular slots such as 78 through its upper surface to provide the advantages of easy automation of the wafer boat loading and unloading operations through use of the apparatus of FIG. 9. In this case, open bottom wafer boats are used to allow reactant gases to flow freely through the wafers and through the elongated slot 9 of the cantilever tube and through the slots 78. In the embodiment of the invention shown in FIG. 1, if polycrystalline silicon or silicon carbide is used to achieve very high temperature operation without sagging of the cantilever tube in the hot zone of the furnace, it may be desireable to construct a hybrid cantilever tube in which the portion closest to the mouth of the diffusion furnace tube is quartz, while the portion that supports the boat loads of wafers in the hot zone of the furnace is silicon carbide or polycrystalline silicon. The lower thermal conductivity of the quartz portion presents excessive conduction of heat out of the furnace to the door and cantilever supporting mechanism.

We claim:

1. An apparatus for effectuating carrying of a plurality of spaced semiconductor wafers into and out of a furnace and also for holding said wafers during a wafer processing operation at elevated temperatures inside said furnace, said apparatus comprising in combination:

(a) a first tube for holding said wafers therein, said first tube having a first end and an open second end, and a wall, said first tube having an elongated slot in a bottom portion of said wall, said elongated slot extending from said open second end along said bottom portion of said wall to a portion of said first tube in which wafer boats are to be positioned;

(b) cantilever supporting means attached to said first end of said first tube for effectuating supporting of said first tube in cantilever fashion during insertion and withdrawal of said first tube into and out of said furnace;

(c) a removable first wafer boat supporting at least some of said wafers, said first wafer boat having a bottom surface which covers and seals a portion of said elongated slot when said first wafer boat is positioned inside said first tube on the bottom inner surface thereof;

(d) means for effectuating flow of gas into and out of said first tube, through said plurality of spaced wafers inside said first tube, and out of said tube while said first tube is being moved in and out of said furnace and while said wafers are being held in said furnace;

(e) boat carrying means extendable through said elongated slot for lifting said first wafer boat above the bottom inner surface of said first tube, laterally moving said first wafer boat along the interior of said first tube above said elongated slot without any portion of said first wafer boat, any of said wafers, or any portion of said boat carrying means touching any portion of said first tube, to effectuate transferring said first wafer boat and wafers therein into and out of said first tube.

2. The apparatus of claim 1 wherein said boat carrying means includes a platform for carrying said first wafer boat or any other wafer boat similar to said first wafer boat, said platform being elongated and sufficiently narrow to extend upward through said elongated slot to support a wafer boat above the inner bottom surface of said first tube.

3. The apparatus of claim 2 wherein said first wafer boat and said other wafer boats have generally semicylindrical bottoms and grooved wafer supporting rods that hold said wafers approximately concentric with said first tube when said wafer boats are resting on the bottom interior surface of said first tube.

4. The apparatus of claim 2 wherein said boat carrying means includes a movable arm having an outer end attached to said platform to support said platform.

5. The apparatus of claim 4 wherein said boat carrying means includes vertical movement means for controlling the movement of said arm to adjust the elevation of said platform to extend through said elongated slot, and further includes axial movement means for controlling the movement of said arm and said platform in a direction parallel to a longitudinal axis of said first tube.

6. The apparatus of claim 5 wherein said boat carrying means includes transvese movement means for controlling movement of said arm to move said platform in a direction transverse to the longitudinal axis of said first tube.

7. The apparatus of claim 6 including control means for controlling the location of said platform and motor means responsive to said control means for moving said vertical movement means, said axial movement means, and said transverse movement means to effectuate loading and unloading of wafer boats into said first tube.

8. The apparatus of claim 7 including a plurality of shelves for supporting wafer boats, said control means also causing said motor means to effectuate movement of said platform to pick up a wafer boat from one of said shelves, carrying that wafer boat to said first tube and loading that wafer boat inside said first tube to cover a predetermined portion of said elongated slot, said control means also causing said motor means to effectuate moveing of said platform to unload a wafer boat from inside said first tube and carrying it a predetermined one of said shelves, and depositing it on that shelf.

9. The apparatus of claim 2 wherein each of said wafer boats has a flat end surface that precisely abuts a similar flat end surface of a previously loaded wafer boat in said first tube so that a plurality of said wafer boats in said first tube perform the function of a cover that effectively seals closed a portion of said elongated slot.

10. The apparatus of claim 5 including manual control means for manual controlling of the location of said platform to effectuate loading a wafer boat into said first tube and unoading that wafer boat from said first tube.

11. The apparatus of claim 1 wherein said cantilever supporting means includes soft landing means for effectuating gently lowering said first tube onto a bottom inner surface inside said furnace after insertion of said first tube into said furnace, and for raising said first tube of said bottom inner surface of said furnace prior to withdrawal of said first tube from said furnace, to prevent sagging of said first tube due to very high temperatures in said furnace.

12. The apparatus of claim 11 wherein said soft landing means includes means for lowering said second end of said first tube onto said bottom inner surface of said furnace before lowering said first end of said first tube onto said bottom inner surface of said furnace to avoid excessive stresses which would occur in said first tube near its first end if its first end were to be lowered by said cantilever supporting means onto said bottom inner surface of said furnace before lowering of said first end.

13. The apparatus of claim 1 wherein said first wafer boat includes a plurality of legs positioned to extend downward through said elongated slot and below the lower surface of said first tube.

14. The apparatus of claim 13 wherein said boat carrying means including means includes means for lowering said first tube enough to rest said first wafer boat on its legs on a lower interior surface of said furnace and break contact with said first wafer boat, and laterally withdrawing said first tube from said furnace without touching siad first boat.

15. The apparatus of claim 1 wherein said first tube has a first means for attachment to said cantilever supporting means and a second means for forming a seal with a mouth opening of said furnace, and further includes an interior exhaust passage means extending through said wall of said first tube between said first and second means to allow reactant gases flowing into said open second end of said first tube to be exhausted for collection by a scavenger.

16. The apparatus of claim 15 including interior bypass passage means in open communication with said interior exhaust passage means and extending through said wall of said first tube on the side of said second means opposite to said first means for ejecting reactant gases flowing in a space between an interior surface of said furnace and an outer surface of said first tube into said exhaust passage means.

17. An apparatus for carrying a plurality of spaced semiconductor wafers into and out of a furnace and also for holding said wafers during a wafer processing operation at elevated temperatures inside said furnace, said apparatus comprising in combination:

(a) a tube for holding said wafers therein and having a wall and a first end and a second end;

(b) cantilever supporting means attached to said first end of said tube for effectuating supporting of said tube in cantilever fashion during insertion and withdrawal of said tube into and out of said furnace;

(c) an opening in said wall of said tube for effectuting loading of said wafers into said tube;

(d) means for covering said opening while said wafers are in said tube;

(e) means for effectuating flow of gas into and out of said tube, through said plurality of spaced wafers located inside said tube, and out of said tube while said tube is being moved in and out of said furnace and while said wafers are being held in said furnace;

(f) wafer transfer means for effectuating transfer of said plurality of wafers into and out of said tube; and (g) soft landing means included in said cantilever supporting means for effectuating gently lowering said second end of said first tube onto a bottom inner surface of said furnace after insertion of said first tube into said furnace and before lowering said first end of said first tube onto said bottom inner surface of said furnace to avoid excessive stresses near said first end of said first tube.

18. A method for carring a plurality of spaced semiconductor wafers into and out of a furnace and also for holding said wafers during a wafer processing operation at elevated temperatures inside said furnace, said method comprising the steps of:

(a) holding a rigid first tube in cantilever fashion at a first end thereof, said first tube having an open second end, a wall, and an elongated slot in a bottom portion of said wall, said elongated slot extending from said second end along said bottom portion of said wall to a portion of said first tube in which wafer boats are to be positioned;

(b) placing a first wafer boat on a platform adjacent to said open second end of said first tube, said platform being sufficiently narrow to pass through said elongated slot without touching said first tube;

(c) moving said platform and said first wafer boat therein so that said platform passes through said elongated slot without touching said first tube and said first wafer boat moves into said first tube thorugh said open end without touching said first tube;

(d) lowering said platform through said elongated slot to clear said first tube and thereby set said first wafer boat on a bottom inner surface of said first tube so that the bottom surface of said first wafer boat sealabley covers a predetermined portion of said elongated slot; and (e) causing gas to flow into said first tube through said wafers and out of said first tube and concurrently moving said first tube with said first wafer boat therein into said furnace.

19. The method of claim 14 including repeating steps (b), (c), and (d) to load a plurality of additional wafer boats in abutting end-to-end relationship to each other to cover and effectively seal an additional predetermined portion of said elongated slot with respect to said gas.

20. The method of claim 14 including the steps of withdrawing said first tube from said furnace while causing gas to flow in said first tube, unloading the lasted loaded one of said wafer boats by moving said platform beneath the last loaded one of said wafer boats, raising said platform through said elongated slot to lift that wafer boat slightly above the bottom inner surface of said first tube, and moving that wafer boat out of said first tube through said open second end thereof.

21. The method of claim 16 including manually performing steps (b), (c), and (d).

22. The method of claim 16 including automatically performing steps (b), (c), and (d) to move wafer boats of unprocessed wafers from a storage rack to the open second end of said first tube to load those wafer boats into said first tube before insertion of said first tube and said wafer boats of unprocessed wafers into said furnace.

23. The method of claim 18 including, after withdrawing said first tube from said furnace, repeating said unloading step for additional ones of said wafer boats.

24. The method of claim 14 including, after step (e), gently lowering said first tube onto a bottom inner surface of said furnace while continuing to support said first tube to thereby prevent sagging of said first tube.

25. The method of claim 20 including lowering siad second end of said first tube onto the bottom inner surface of said furnace before lowering said first end of said first tube onto the bottom inner surface of said furnace to avoid excessive stress near said first end of said first tube.

26. An apparatus for effectuating carrying of a plurality of spaced semiconductor wafers into and out of a furnace and also for holding said wafers during a wafer processing operation at elevated temperatures inside said furnace, said apparatus comprising in combination:

(a) a first tube for holding said wafers therein, said first tube having a first end and an open second end, and a wall, said first tube having an elongated slot in a bottom portion of said wall, said elongated slot extending from said open second end along said bottom portion of said wall to a portion of said first tube in which wafer boats are to be positioned;

(b) cantilever supporting means attached to said first end of said first tube for effectuating supporting of said first tube in cantilever fashion during insertion and withdrawal of said first tube into and out of said furnace;

(c) removable first wafer boat means supporting at least some of said wafers, for supporting those wafers over said elongated slot when said first wafer boat means is positioned inside said first tube on the bottom inner surface thereof;

(d) means for effectuating flow of gas into said first tube, through said plurality of spaced wafers inside said first tube, and out of said tube while said first tube is in said furnace and while said wafers are being held over said elongated slot; and (e) boat carrying means extendable through said elongated slot for lifting said first wafer boat means above the bottom inner surface of said first tube, laterally moving said first wafer boat along the interior of said first tube above said elongated slot without any portion of said first wafer boat, without any of said wafers, or any portion of said boat carrying means touching any portion of said first tube, to effectuate transferring said first wafer boat and wafers therein into and out of said first tube.

27. The apparatus of claim 1 wherein said first tube has a plurality of semicircular slots above said elongated slot.

* * * * *

UNITED STATES PATENT AND TRADEMARK OFFICE

CERTIFICATE OF CORRECTION

PATENT NO. : 4,543,059

DATED : September 24, 1985

INVENTOR(S) : J. S. Whang and Andrew F. Wollmann

It is certified that error appears in the above-identified patent and that said Letters Patent are hereby corrected as shown below:

In Column 3 of the issued patent, line 1,
delete "copntrolled", substitute --controlled--;
delete "driving", substitute --during--.

In Column 4 of the issued patent, line 64,
delete "gases", substitute --gas is--.

Signed and Sealed this

*Eleventh* Day of *March 1986*

[SEAL]

*Attest:*

DONALD J. QUIGG

*Attesting Officer*

*Commissioner of Patents and Trademarks*